US009123458B2

(12) United States Patent
Griffin

(10) Patent No.: US 9,123,458 B2
(45) Date of Patent: Sep. 1, 2015

(54) POWER CABLE

(75) Inventor: Michael D. Griffin, Rochester Hills, MI (US)

(73) Assignee: Essential Sound Products, Inc., Rochester Hills, MI (US)

( * ) Notice: Subject to any disclaimer, the term of this patent is extended or adjusted under 35 U.S.C. 154(b) by 538 days.

(21) Appl. No.: 12/480,819

(22) Filed: Jun. 9, 2009

(65) Prior Publication Data

US 2010/0307811 A1 Dec. 9, 2010

(51) Int. Cl.
*H01B 11/04* (2006.01)
*H01B 11/12* (2006.01)

(52) U.S. Cl.
CPC ..... *H01B 11/12* (2013.01)

(58) Field of Classification Search
USPC ..... 174/105 R, 113 R, 113 C, 116
See application file for complete search history.

(56) References Cited

U.S. PATENT DOCUMENTS 5,864,094 A * 1/1999 Griffin ..... 174/105 R
7,060,905 B1 * 6/2006 McMahon ..... 174/110 R
7,180,002 B2 2/2007 Bertges et al.

* cited by examiner

*Primary Examiner* — Chau N Nguyen
(74) *Attorney, Agent, or Firm* — Young Basile Hanlon & MacFarlane, P.C.

(57) ABSTRACT

An electrical power cable includes a central support or a ground conductor surrounded by an insulating material layer. An inner grounded shield is disposed on the support or on the ground conductor. A plurality of insulated line conductors and a plurality of insulated neutral conductors are circumferentially disposed in an annular arrangement about an insulation layer on the inner shield. The plurality of line and neutral conductors are disposed in various alternating single, double or triple conductor groups. The total cross-sectional area of all of the line conductors or all of the neutral conductors is substantially equal to the total cross-sectional area of a single large conductor of equivalent ampere rating. An outer shield is disposed about the line and neutral conductors and covered by an outer insulating layer.

30 Claims, 10 Drawing Sheets

POWER CABLE

BACKGROUND

The present disclosure relates, in general, to electrical conductors, and, more specifically, to shielded electrical power supply cables.

Internal electrical wiring in residential homes for 15 ampere A.C. power supply electrical service has for years been standardized as 14-2G type NM-B sheathed cable. This sheathed cable consists of three 14 gage solid conductors, with the line and neutral conductors individually insulated and disposed in a parallel flat lay on opposite sides of an insulated ground conductor. This cable construction has several features which minimize magnetic field interaction and damping of mechanical vibrations generated by the 60 Hz North America electrical power carrier frequency. Such features include the spacing apart of the current carrying line and the neutral conductors, the use of relatively stiff, solid 14 AWG conductors, and relatively stiff insulation and cable jacket. These features combine to minimize interaction of the magnetic fields and resist the attracting and repelling forces caused by the magnetic fields associated with the two closely spaced line and neutral conductors.

Conversely, typical A.C. power supply cords for electrical appliances, such as audio amplifiers, preamplifiers, etc., have a construction that is optimized for maximum flexibility and durability in potentially high flex cycle applications. Such power supply cords have close conductor spacing geometry, which increases magnetic interaction between the line and neutral current carrying conductors. Such cords also typically use stranded conductors and soft fillers, such as cotton and paper, between the conductors and the outer jacket material. All of these features compromise the self-damping quality of the power supply cord thereby leading to increased vibration of the individual conductors due to the interacting magnetic fields generated by the current carrying conductors. The movement of the conductors due to magnetic field interaction is also enhanced by the use of the soft fillers and the relatively flexible outer jacket.

The inventor previously devised a power cable described in U.S. Pat. No. 5,864,094, which is particularly suited for use in supplying electrical power to audio equipment, since it has reduced magnetic field interactions between the line and neutral conductors, less vibration of the individual current carrying conductors, has a solidly filled construction to minimize any movement of the individual conducts within the cable, and has a reduced inductance.

It would still be desirable to provide a cable for electrical applications including supplying electrical power to audio equipment or acting as audio speaker cable which meets the functionality of the inventors' previously devised cable, but which has different line and neutral conductor configurations to further optimize current handling characteristics.

SUMMARY

An electrical power cable, which is particularly useful in supplying A.C. electrical power to audio equipment of the present invention includes a centrally disposed ground conductor surrounded by a first insulating material layer. A plurality of line conductors, each of like gage and covered by a second insulating material layer, are disposed about the first insulating layer of the ground conductor. A plurality of neutral conductors, each also of like gage and covered by a third insulating material layer, are disposed about the insulating layer of the ground conductor. A fourth insulating material layer surrounds the line and neutral conductors. A grounded outer shield is disposed about the fourth insulating material layer. An outer insulation material layer covers the outer shield.

In several different arrangements, the plurality of line conductors and neutral conductors are arranged in a circumferential layer about a central cable axis in various alternating single, double and triple conductor groups.

In one aspect, the line conductors and neutral conductors are arranged in a one-to-one side-by-side arrangement of alternating line conductors and neutral conductors. In another aspect, the line conductors and neutral conductors are arranged in adjacent disposed pairs of line conductors and neutral conductors each pair alternating between a pair of line conductors and a pair of neutral conductors and yet another aspect, the line conductors and neutral conductors are arranged in a group of three line conductors or neutral conductors. The groups of three conductors are alternate about the central cable axis between a group consisting of three line conductors and a group consisting of three neutral conductors.

Further, the total cross-sectional area of the plurality of line conductors and the total cross-sectional area of the plurality of neutral conductors is substantially equal to the cross-sectional area of a single line conductor and a single neutral conductor of an equivalent electrical ampere rating.

In one arrangement of line and neutral arrangement conductors, the line conductors and the neutral conductors are arranged in a single circumferential layer about the central cable access in an alternating one-to-one arrangement where each line conductor is disposed between oppositely disposed neutral conductors and each neutral conductor is disposed between oppositely disposed line conductors.

In another aspect, the line conductors and the neutral conductors are arranged in alternating pairs of line conductors and neutral conductors about the central cable axis.

In yet another aspect, the line conductors and the neutral conductors are arranged in alternating groups formed of three line conductors or three neutral conductors each.

All of the insulating material layers used in the power cable can be formed of a semi-rigid, substantially non compressible material, such as PCV, to prevent movement of the individual conductors with respect to each other within the power cable.

An inner grounded shield is formed, in one aspect by the outer surface of the ground conductor. In another aspect, a grounded conductive inner shield is spaced from the ground conductor by an insulating material layer. The inner shield is separated from the plurality of line and neutral line conductors by another insulating material layer. The outer diameter of the first insulating material layer in the first aspect of the outer diameter of the insulating material layer surrounding the inner shield in the other embodiment enables the line and neutral conductors to lie in one annular ring in contact with each other.

In one aspect, the thickness of the insulation material layers surrounding the line and neutral conductors, the center ground conductor and between the center ground conductors, the inner shield means, and the outer shield are substantially equal.

In yet another aspect, the central ground conductor of the power cable is replaced by an inner support having a diameter suited to position the inner shield at a desired diameter within the cable. This cable is particularly suited for use as an audio speaker cable. Any of the disclosed arrangements of line and neutral conductors may be employed in this aspect of the inventive cable.

The inventive electrical cable provides numerous advantages over previously devised cables, particularly power cables used to supply A.C. power to audio equipment, or audio speaker cables. The fixed non-movable positioning of the individual conductors within the cable in combination with the use of a plurality of smaller gage conductors for the line and neutral conductors which reduces magnetic field interaction between the current carrying line and neutral conductors minimizes movement or vibration of the conductors which heretofore has generated eddy current which reduce the amount of current carried by power cables. Further, the use of the plurality of small gage line and neutral conductors substantially reduces the cross-sectional area between the inner and outer shields of the cable thereby significantly reducing the inductance of the cable which heretofore also reduced the amount of current carried by the cable.

The various arrangements of line and neutral conductors within their overall annular arrangement enables further optimization of current handling properties of the cable.

BRIEF DESCRIPTION OF THE DRAWING

The various features, advantages and other uses of the present invention will become more apparent by referring to the following detailed description and drawing in which.

DETAILED DESCRIPTION

Figure 1:
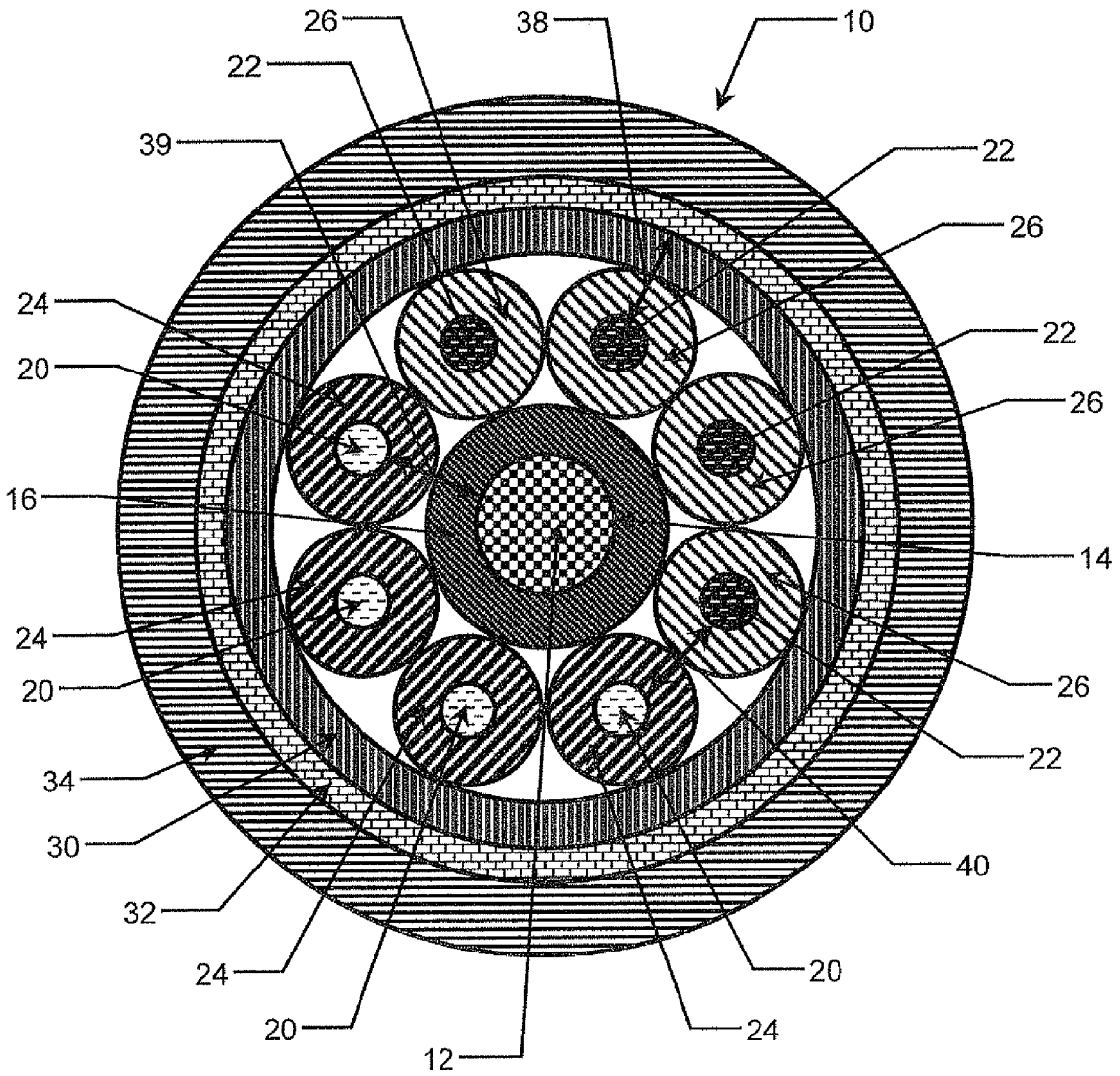
FIG. 1 is a cross sectional view of one aspect of a power cable.

Referring now to the drawing and to FIG. 1 in particular, there is depicted one aspect of a power cable 10

The power cable 10 is explained with features described hereafter in a specific application as being equivalent to a 14 AWG power cable. It will be understood that following features of the power cable 10 may be applied to different gage power cables, as described for example in the aspect shown in FIG. 2.

The power cable 10 includes an inner, centrally located ground conductor 12. The outer surface 14 of the inner conductor 12 acts as an inner shield for the power cable 10. In the specified example of a 14 AWG power cable, the ground conductor 12 must be at least a 14 AWG conductor to meet its required safety rating. However, in this embodiment, the ground conductor 12 is made oversized, i.e., a larger diameter gage, such as a 12 AWG conductor of either stranded or solid wire. An insulating material layer 16 with a minimum insulation thickness of 0.032 inches is disposed or wrapped about the ground conductor 12. The described oversized 12 AWG ground conductor 12 provides additional functionality as an inner shield since the outer diameter of the ground conductor 12 is positioned to reduce the cross-sectional area of the annulus spacing containing the line and neutral conductors described hereafter.

The insulation 16 surrounding the ground conductor 12 may be formed of any suitable electrical insulating material. Preferably, PVC material in employed due to its relative stiffness and non-compressibility which aids in damping any vibration of the conductor 12.

The single line conductor and single neutral conductor normally used in a 14 AWG power cable are replaced in the present power cable 10 by a plurality of individual, smaller gage conductors. The plurality of small gage conductors has a combined or total cross-sectional area substantially equal to the cross-sectional area of the single 14 AWG conductor they replace. Since a 14 AWG conductor has a cross-sectional area of 0.00323 inches$^2$, four 20 AWG conductors which have a combined cross-sectional area of 0.00328 inches$^2$ are used for each of the individual line conductors and each of the individual neutral conductors. Thus, as shown in FIG. 1, the power cable 10 includes four 20 AWG neutral conductors 20 and four 20 AWG line conductors 22. Any conductor size, which is 20 AWG or smaller, can be employed for consistent current handling performance in the audible frequency range (10 Hz-10 kHz) and no high frequency roll off.

Figure 4:
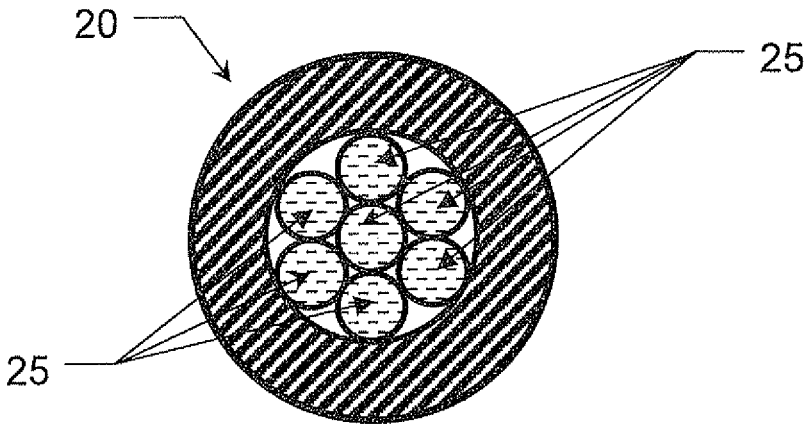
FIG. 4 is an enlarged cross-sectional view of an alternate line or neutral conductor formed of stranded wires configured in a 'concentric lay'.

The individual neutral conductors 20 and the individual line conductors 22 may each be formed of a solid conductor surrounded by a single insulation layer 24 or 26, preferably of PVC. The single conductor covered with an outer insulation jacket affords an optimum stiffness versus flexibility characteristic for mechanical damping of any induced vibrations in the conductor. Stranded conductors, also shown in FIG. 4, may also be employed for the line and neutral conductors, such as conductor 20, as long as the strands 25 are arranged in a "perfect" or "concentric lay" in the conductor 20. Concentric lay conductors are formed from concentric layers of carefully laid strands, keeping the conductor section perfectly circular.

In this example, 7 strands of 28 AWG wire are arranged six around one to form a composite 20 AWG conductor.

Figure 3:
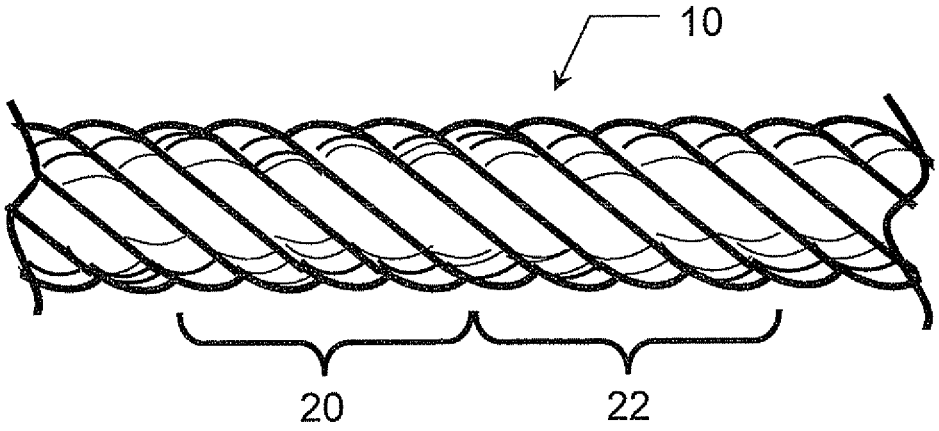
FIG. 3 is a partial, side elevational view of the helical lay of the conductors in the power cable.

As shown in FIG. 3 the plurality of line and neutral conductors 22 and 20 are wrapped in a helical arrangement about the ground conductor 12 and along the length of the power cable 10 to break up coil inductance in the power cable 10. However, a parallel arrangement of the conductors 22 and 20 is also feasible in the power cable 10.

An inner jacket 30 formed of an electrical insulating material, preferably PVC, is disposed around and in intimate contact with the insulation jackets 24 and 26 of the neutral conductors 20 and the line conductors 22, respectively. The inner jacket 30 serves to maintain the conductors 20 and 22 in their specified side-by-side arrangement as well as adding an additional degree of stiffness to the power cable 10 to resist any movement or vibration of the individual conductors 20 and 22 within the power cable 10.

An outer ground shield 32 is disposed about the inner jacket 30. The outer shield 32 is formed of a suitable conductive material, such as copper braid, aluminum foil, etc. Finally, an outer electrical insulating material jacket 34 is disposed about the outer shield 32 to complete the power cable 10. The outer insulating layer 34, like the inner jacket 30 is also formed preferably of PVC.

The power cable 10 also includes several dimensional relationships between the individual components, which significantly improves its performance. First, the diameter or gage of the ground conductor 12 and the thickness of the insulating layer 16 disposed about the inner ground conductor 12 are selected to provide a combined outer diameter which closely conforms to the inner diameter of the plurality of line and neutral conductors 20 and 22 disposed about the ground conductor 12. This is to insure registry of all of the conductors 20 and 22 within the power cable 10 to minimize movement caused by any induced vibrations in the conductors 20 and 22.

In addition, the thickness of the insulating jackets 24 and 26 on the neutral conductors 20 and line conductors 22 are optionally at least equal to the diameter of each conductor 22 and 20. Thus, for the exemplary 20 AWG conductors 20 and 22, which have a diameter of approximately 0.032 inches, the thickness of the jackets 24 and 26, respectively, is also 0.032 inches. In the specified alternating arrangement of the neutral conductors 20 and the line conductors 22, this insulation thickness significantly contributes to minimizing magnetic field interaction between the conductors 20 and 22 as compared to typical power cable conductor construction. Since magnetic field strength is an inverse square function of the distance from the center of the conductor, the power cable 10 spaces the centers of two adjacent conductors 20 and 22 apart by a least two diameters to significantly reduce the strength of the magnetic field generated between two adjacent conductors 20 and 22 carrying current in opposite directions.

The thickness of the various insulation jackets 24 and 26 as well as the thickness of the insulation layer 16 covering the ground conductor 12 and the inner jacket 30 are substantially equal so as to place the various conductors 12, 20 and 22 at an identical distance apart from each other as well as at the same distance from the inner shield 14 as shown by reference number 40 and the outer shield 32. For example, as described above for 20 AWG conductors used for the line and neutral conductors 22 and 20, an insulation jacket of 0.032 inches thick as well as a 0.032 inch thick insulation layer 14 surrounding the ground conductor 12 and a 0.032 inch thick inner jacket 30, will place the outer surface of each of the line and neutral conductors 22 and 20 0.064 inches from the inner surface of the outer shield 32 and 0.064 inches from the outer surface of the inner shield 14 on the ground conductor 12 as shown by reference number 39. The outermost surfaces of conductors 20 and 22 are also spaced 0.064 inches from the outer surface of adjacent conductors, as shown by reference number 40 in FIG. 1. This provides an overall symmetry to the power cable 10, which minimizes magnetic field interaction between the various conductors 20 and 22.

Figure 5:
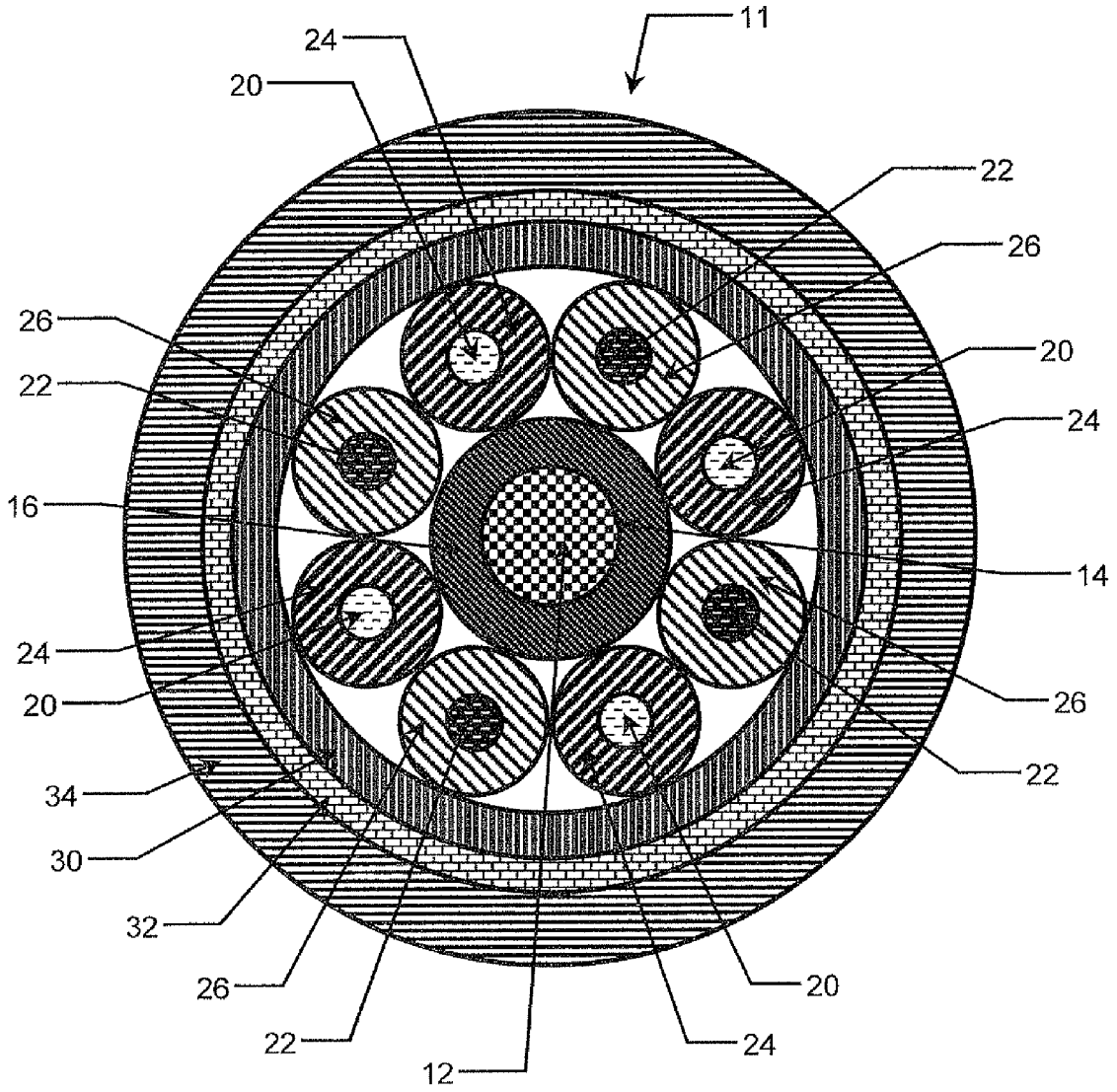
FIG. 5 is an enlarged cross-sectional view of another aspect of a power cable.

The arrangement of the conductors 20 and 22 in one annular ring between the outer surface 14 of the ground conductor 12 which acts as an inner shield and the outer shield 32 also contributes to a minimized cross-sectional area between the inner shield 14 and the outer shield 32 which reduces the inductance of the power cable 10. Any reduction in cable inductance reduces the current lag, Referring now to FIG. 5, there is depicted a power cable 11 which is substantially identical to the power cable 10 except for a new arrangement of the neutral conductors 22 and the line conductors 20. In this aspect, the plurality of neutral conductors 22 are disposed in an alternating, one-to-one, side-by-side arrangement with the line conductors 22 such that each neutral conductor 20 is disposed between two oppositely adjacent oppositely line conductors 20, and each individual line conductor 22 is disposed between two adjacent neutral conductors 20.

Figure 6:
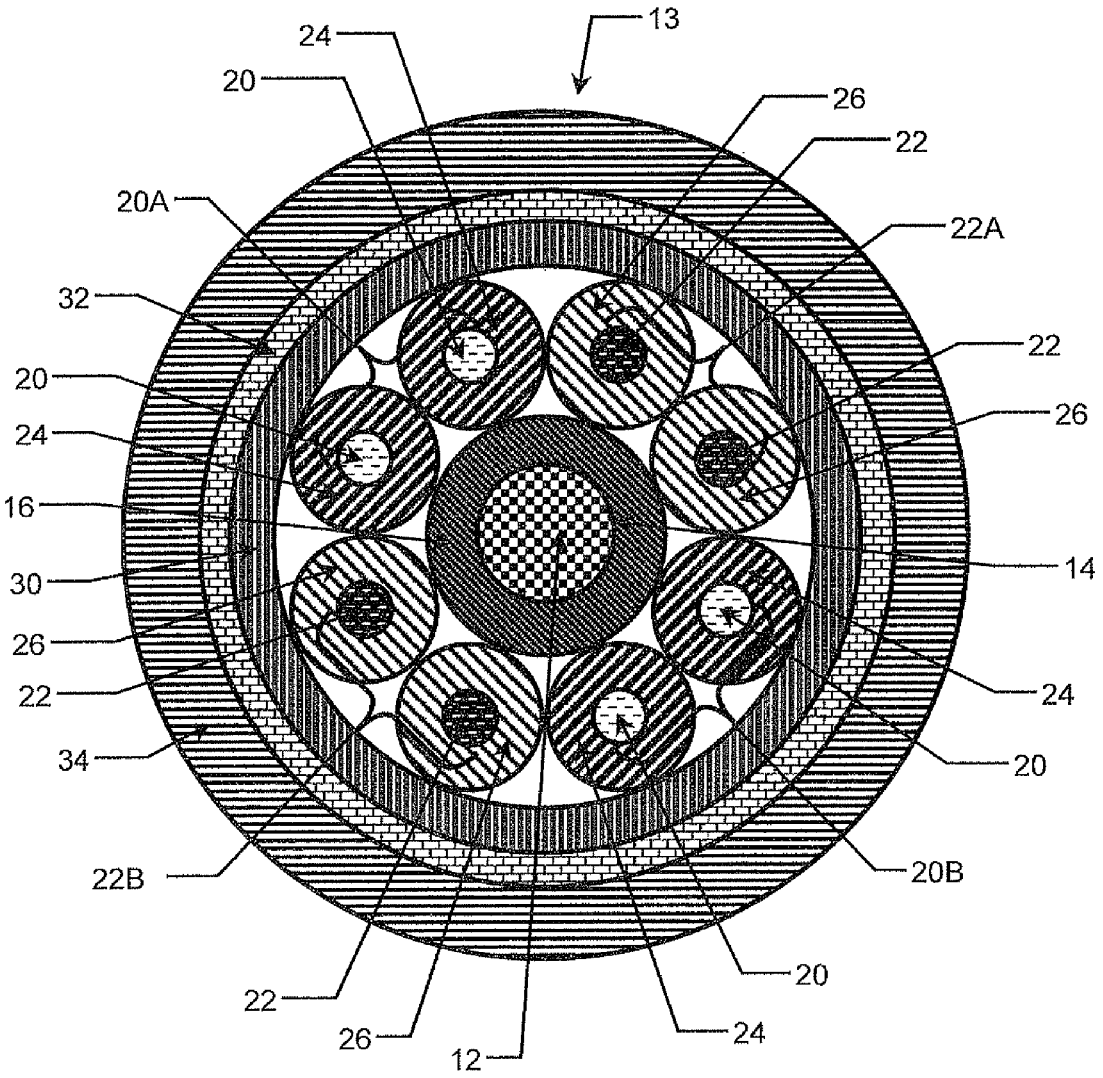
FIG. 6 is an enlarged cross-sectional view of another aspect of a power cable.

Another modification of the arrangement of the conductors 20 and 22 in a power cable 13 is shown in FIG. 6. In this aspect, the neutral conductors 20 and the line conductors 22 are arranged in alternating pairs 20A and 20B of neutral conductors 20 and alternating pairs 22A and 22B of line conductors 22. Each single pair of neutral conductors 20 is disposed between adjacent pairs 22A and 22B of line conductors, and each pair 22A and 22B of line conductors 22 is disposed between adjacent pairs 20A and 20B of neutral conductors 20.

In this arrangement, each neutral conductor 20 or line conductor 22 is disposed adjacent to only one opposite current carrying conductor 22 or 20 so as to minimize magnetic field interaction.

Figure 2:
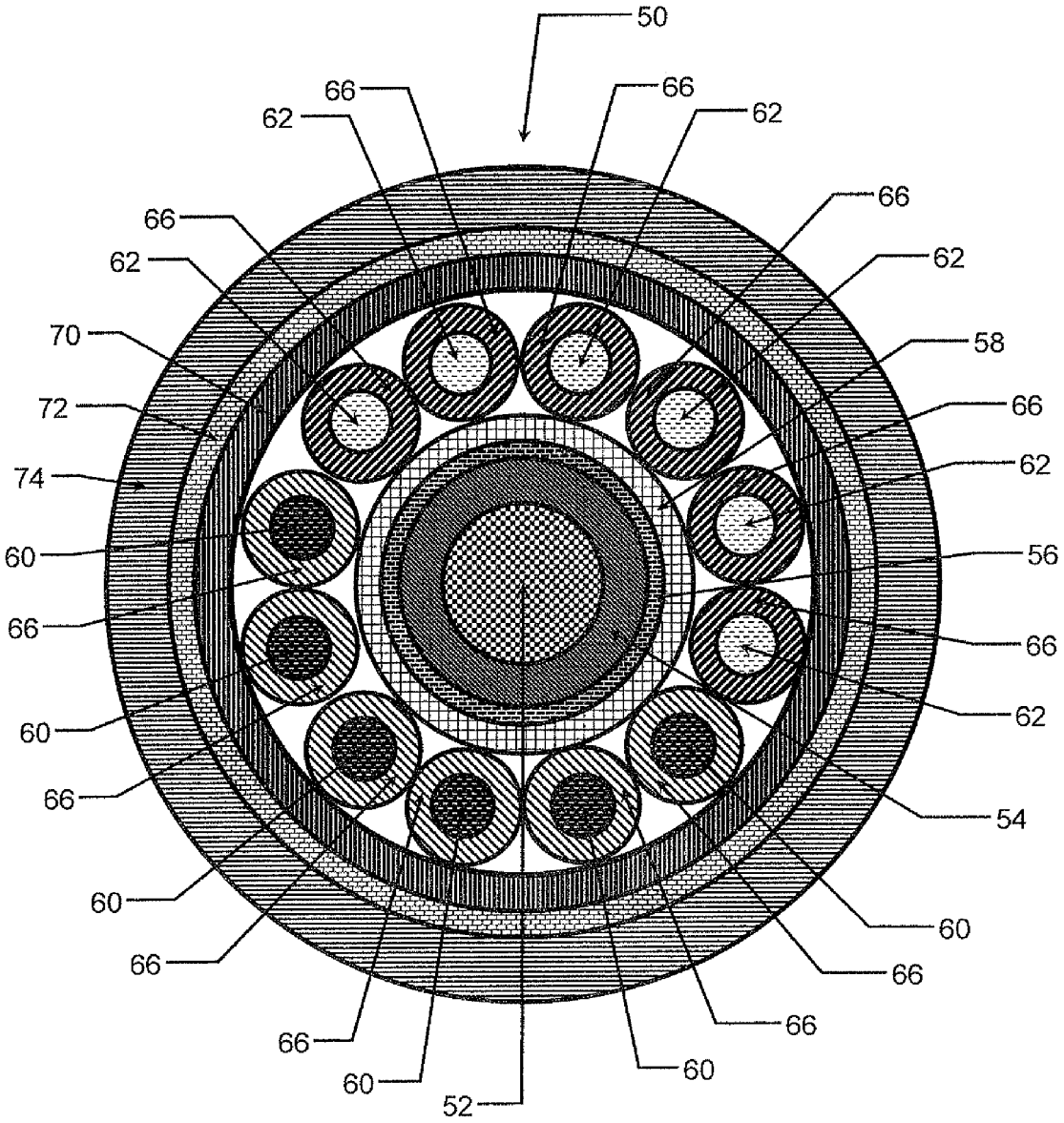
FIG. 2 is a cross-sectional view of another aspect of a power cable.

Referring now to FIG. 2, there is depicted another embodiment of a power cable 50 constructed in accordance with the teachings of the present invention. The power cable 50 is substantially identical to the power cable 10 described above and shown in FIG. 1, except for a few differences which will be enumerated hereafter.

The power cable 50 is designed to replace a 12 AWG power cable containing a single 12 AWG line conductor, a single 12 AWG neutral conductor and a single 12 AWG center located ground conductor. The power cable 50 includes an inner ground conductor 52, which is preferably formed of a single, stranded or solid 12 AWG conductor for electrical rating purposes. An insulation layer 54 surrounds the ground conductor 52. An inner shield 56 is disposed about the insulation layer 54. The inner shield 56 is formed of an electrically conductive material, such as copper braid, aluminum foil etc. Another insulation layer 58 surrounds the inner shield 56, for insulation purposes to provide an appropriate diameter for close fitting of the individual line and neutral line conductors in an annular arrangement, and to minimize cross sectional area between inner and outer shields.

As shown in FIG. 2, each group of neutral conductors 62 and line conductors 60 are arranged side-by-side with the outer insulation jackets or layers 66 of each conductor 62 and 60 contacting the insulation jacket at the adjacent conductor 60 or 62. Thus, as shown in FIG. 2, the six neutral conductors 62 are arranged side-by-side along an arcuate portion of the ground conductor 52; while the line conductors 602 are arranged side-by-side on an opposite arcuate side of the ground conductor 52.

A plurality of individual line and neutral conductors 62 and 60 are employed to replace a single 12 AWG line conductor and a single 12 AWG neutral conductor. The number of individual line and neutral conductors 62 and 60 is selected to equal the cross-sectional diameter of a single 12 AWG conductor. Thus, six 20 AWG line conductors and six 20 AWG neutral conductors 60 are employed in two separate side-by-side, annular groups within the power cable 50.

The power cable 50 also includes an inner, insulative jacket 70, an outer shield 72 formed of a suitable conductive material, such as copper braid, aluminum foil, etc., and an outer insulative jacket 74.

As in the first aspect, all of the insulation layers or jackets in the power cable 50 are formed of non-compressive PVC. Further, as in the first embodiment, the thicknesses of the insulation layers and the insulation jackets are selected to provide symmetry between the spacing of the various conductors and shields. Thus, the conductor insulation layer 66 is preferably as thick as the diameter of the conductors 60 or 62, i.e., 0.032 inches for the exemplary 20 AWG conductors. This spaces each conductor 60 and 62 0.064 inches from the adjacent conductor, the inner jacket 70 and the insulating layer 58 are sized to space the conductors 60 and 62 0.045 from the inner shield 56 and the outer shield 72. This arrangement minimizes magnetic field interaction between the various current carrying conductors 60 and 62.

As in the first aspect, an inner shield is provided in the power cable 50. In the exemplary 12 AWG size cable 50, it is economically impractical to form the ground conductor 52 in a large enough diameter. Thus, a 12 AWG size conductor is employed along with less expensive insulation layers 54 and 58, and the grounded inner shield 56 which is positioned to reduce the overall cross-sectional area and thereby the inductance of the portion of the power cable 50 which carries the current carrying conductors 60 and 62.

Figure 7:
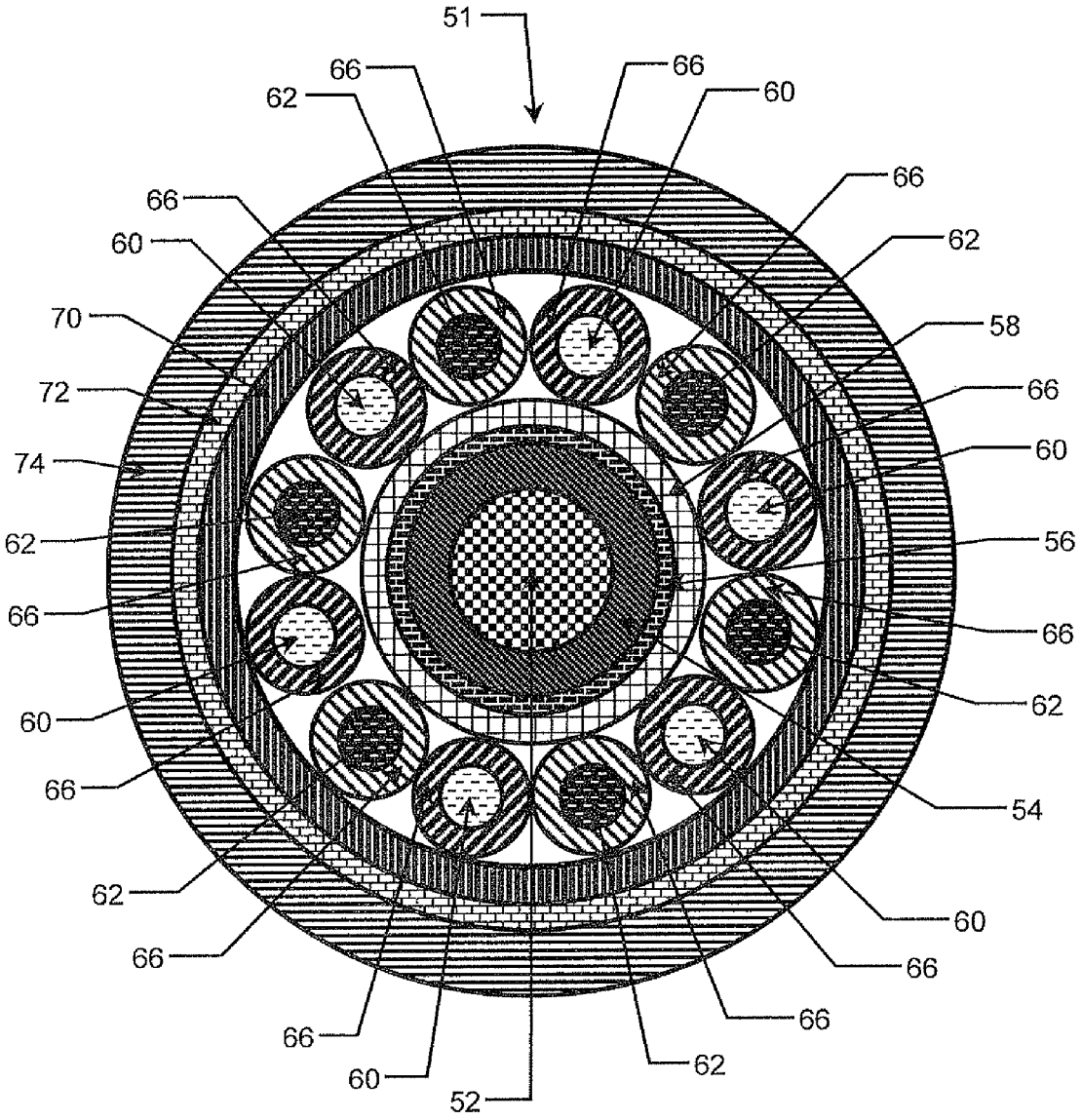
FIG. 7 is an enlarged cross-sectional view of another aspect of a power cable.

A power cable 51 is shown in FIG. 7. The power cable 51 is substantially identical to the power cable 50 except for a rearrangement of the positions of the neutral conductors 20 and the line conductors 22 within the power cable 51.

The neutral conductors 20 and the line conductors 22 are arranged in a single circumferential layer about the central cable axis formed by the ground conductor 12 in alternating, one-to-one arrangement where each neutral conductor 20 is disposed between a pair of adjacent line conductors 62 and each line 62 is disposed between adjacent neutral conductors 60.

This arrangement also minimizes magnetic field interaction by the opposite direction current carrying neutral conductors 60 and line conductors 62 since each conductor is isolated between two opposite current carrying direction conductors.

Figure 8:
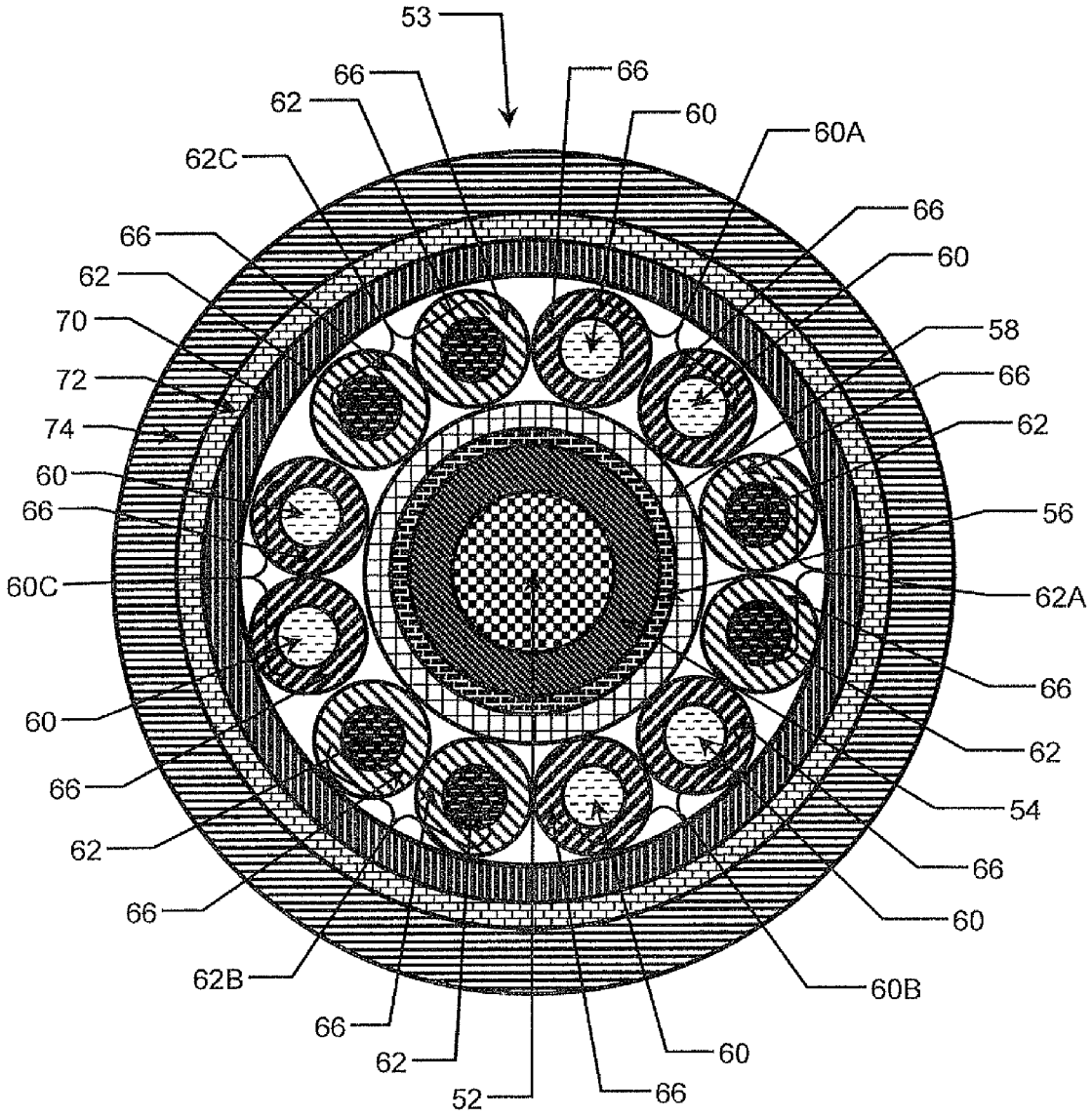
FIG. 8 is an enlarged cross-sectional view of another aspect of a power cable.

Referring now to FIG. 8, there is depicted another power cable 53, which is substantially identical to power cable 50, except for a modification to the arrangement of the neutral and line conductors 60 and 62.

In this aspect, the six neutral conductors 60 are arranged in a plurality of pairs, such as three pairs 60A, 60B, and 60C. The six line conductors 62 are also arranged in a plurality of pairs, such as three pairs 62A, 62B and 62C. Each pair 60A, 60B and 60C of neutral conductors is disposed between two adjacent pairs 62A, 62B or 62C of line conductors. Likewise, each pair 62A, 62B and 62C of line conductors 62 is disposed between two adjacent pairs 60A, 60B, and 60C of neutral line conductors 60.

Figure 9:
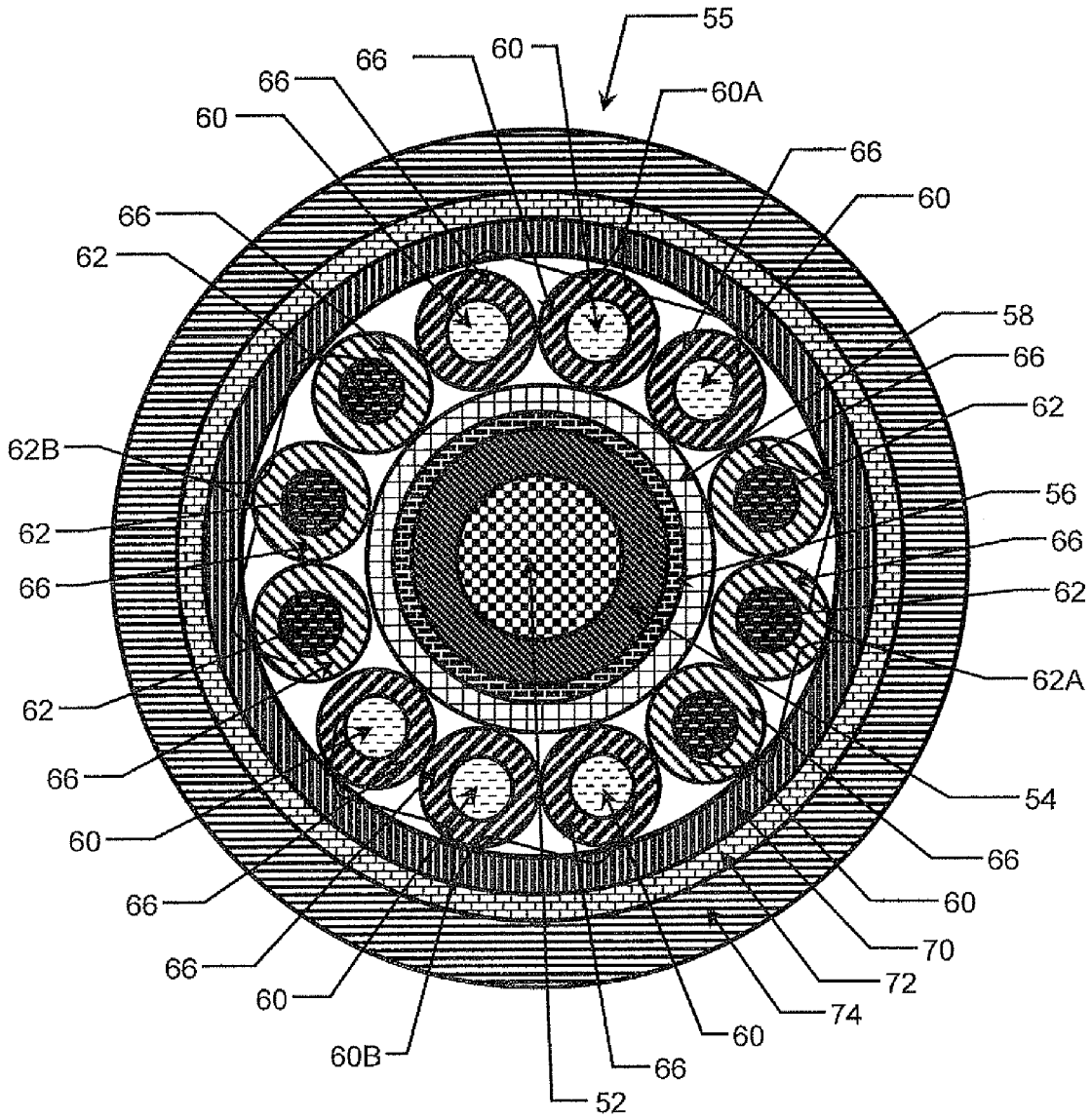
FIG. 9 is an enlarged cross-sectional view of another aspect of a power cable.

As shown in FIG. 9. A power cable 55 is substantially identically constructed as the power cable 50 except for a different arrangement of the neutral conductors 60 and the line conductors 62 about the center ground conductor 52.

In this aspect, the neutral conductors 60 are arranged in two triplet groups or sets 60A or 60B of three neutral conductors each where the two groups are diametrically opposed from each other about the inner ground conductor 52. Likewise, the six line conductors 62 are disposed in two pairs 62A and 62B of triplets or groups of three line conductors 62 each where the two groups are also diametrically opposed from each other about the inner ground conductor 52.

In this arrangement, each group 60A or 60B of three neutral conductors 60 is disposed between the two groups 62A and 62B of line conductors 62. This places only one neutral conductor 60 immediately adjacent to one line conductor 62 which reduces the strength of the magnetic field generated between the two adjacent conductors 60 and 62 which carry current in opposite directions. The central neutral conductor 60 in each group 60A and 60B of neutral conductors 60 and 60 is disposed between two like neutral conductors 60 thereby further reducing any magnetic field generated between opposite current carrying conductors in the cable 55.

Figure 10:
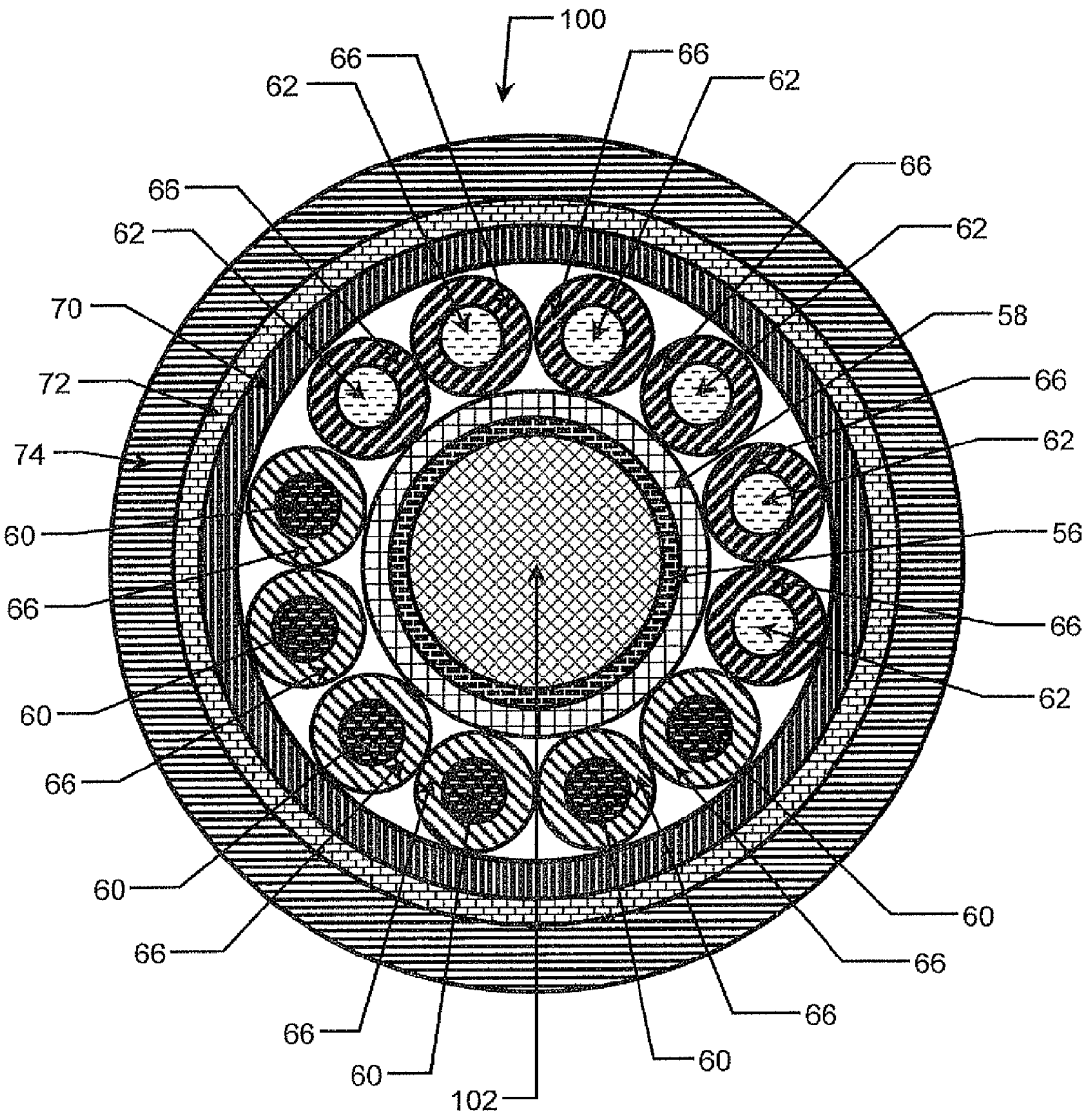
FIGS. 10 and 10A are cross-sectional views of different aspects of a cable suited for use as an audio speaker cable.
Figure 10A:
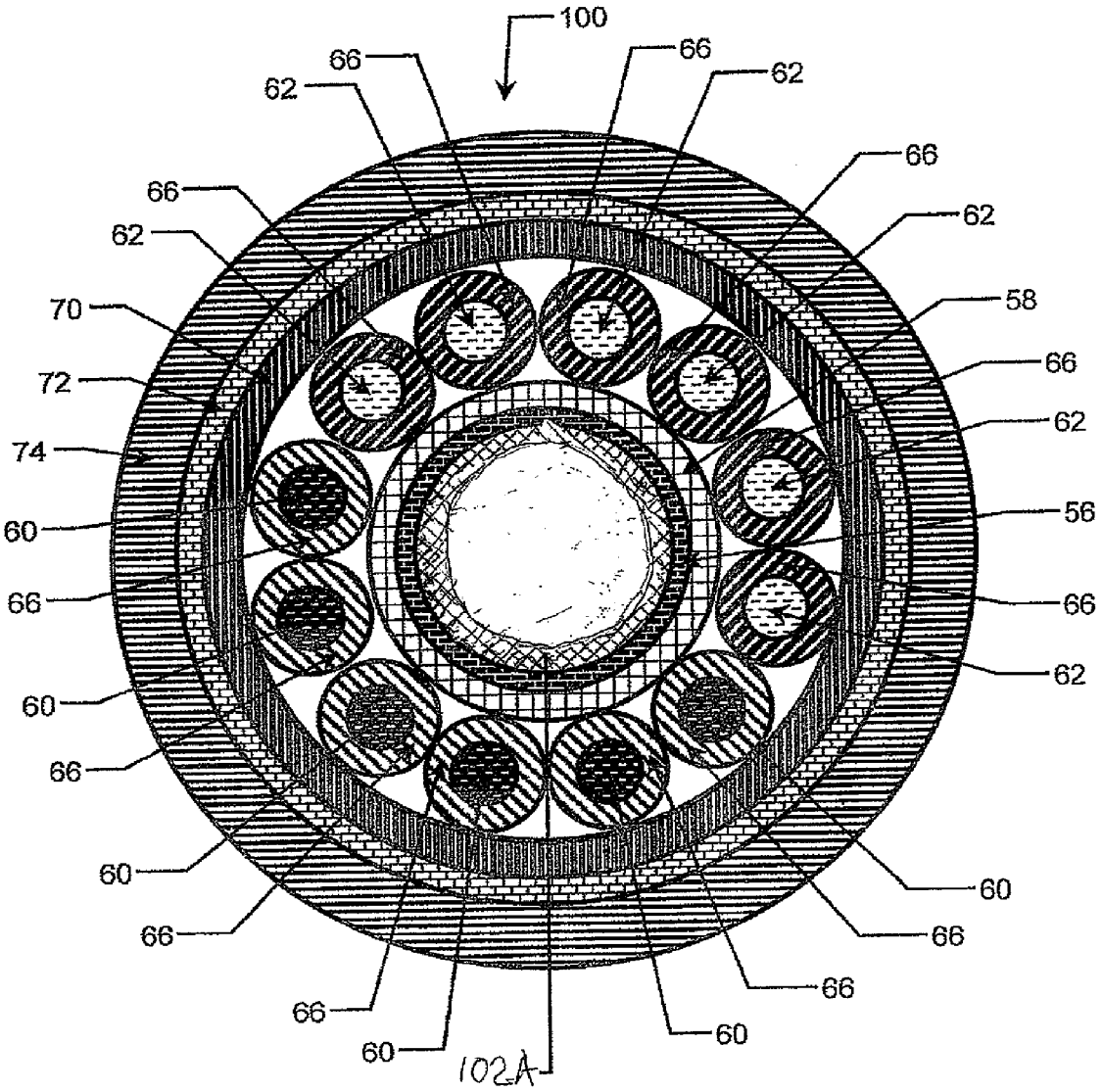

A cable 100, shown in FIGS. 10 and 10A, is advantageously useable for audio speaker cables. The cable 100 is substantially identical to cable 50 shown in FIG. 2 in that it includes six neural conductors 60 and six line or positive conductors 62, each arranged in a circumferential group opposed from the other group of conductors 60 or 62. However, in this aspect, the inner ground conductor 52 is replaced by a support 102 for the inner shield 56. The support 102 can be formed of an electrically insulated material and may be solid, as shown in FIG. 10, or formed of a hollow tube 102A as seen in FIG. 10 so as to support the inner shield 56 at the proper diameter.

An optional insulation layer 58 may be provided about the inner shield 56 for insulation purposes and to provide an appropriate diameter for close fitting of the line and neutral conductors 60 and 62 in an annular arrangement and to minimize cross-sectional area between the inner and outer shields 56 and 58.

The cable 100 may also employ the various arrangements of neutral conductors 20, 60 and line conductors 22, 62 previously described for the cables 51, 53 and 55. This means that the cable 100 may have the neutral and line conductors 20, 60 and 22, 62 arranged in an alternating one-to-one side by side configuration, in alternating pairs or in two pairs of triplet groups.

In summary, there has been disclosed a unique power cable suitable for use in supplying A.C. electrical power to electrical devices, such as audio equipment. The unique construction of the power cable minimizes magnetic field interaction between the current carrying conductors to reduce vibrations in the conductors. The use of relatively stiff PVC insulation around each conductor and for the various insulating shields and layers in the inventive power cable provides a solid, non-moveable construction for the cable which damps any mechanical vibrations which may be induced in the conductors. Further, the provision of an inner shield and an outer shield surrounding the current carrying conductors and the use of a plurality of smaller diameter conductors having a total cross-section equal to the larger diameter of a single conductor of equivalent ampere rating minimizes the cross-section of the power cable between the inner and outer shields thereby reducing the inductance of the power cable.

What is claimed is:

1. An electrical power cable comprising:

a ground conductor;

a first insulating material layer disposed about the ground conductor;

a plurality of line conductors arranged in a plurality of discrete groups, each line conductor covered with a second layer of insulation material, each line conductor circumferentially disposed about the first insulating material layer;

a plurality of neutral conductors arranged in a plurality of discrete groups, each neutral conductor covered by a third layer of insulating material, each neutral conductor circumferentially disposed about the first insulating material layer;

the plurality of groups of line conductors and the plurality of groups of neutral conductors disposed in an alternating side-by-side arrangement about the first insulating material layer;

a fourth layer of insulating material surrounding the plurality of groups of line conductors and the plurality of groups of neutral conductors;

an outer conductive shield disposed about the fourth insulating material layer; and an outer insulating layer disposed about the outer shield.

2. The electrical power cable of claim 1 wherein:

the magnetic field interaction between the plurality of line conductors and the plurality of neutral conductors is less than the magnetic field interaction in an electrical power cable having a single line conductor and single neutral conductor of substantially equal current carrying capacity to the current carrying capacity of the plurality of line conductors and plurality of neutral conductors.

3. The electrical power cable of claim 2 wherein:

each group of line conductors includes a single line conductor and each group of neutral conductors includes a single neutral conductor; and the plurality of groups of line conductors and the plurality of groups of neutral conductors are arranged in alternating one-to-one group arrangement about the first insulating material layer.

4. The electrical power cable of claim 1 wherein:

the total cross-sectional area of the plurality of neutral conductors and the total cross-sectional area of the plurality of line conductors each is substantially equal to a cross-sectional area of a single neutral conductor and a single line conductor, respectively, of a corresponding ampere rating.

5. The electrical power cable of claim 1 wherein:

each group of line conductors includes a pair of line conductors and each group of neutral conductors includes a pair of neutral conductors; and the plurality of groups of line conductors and the plurality of groups of neutral conductors are arranged in alternating pairs of line conductors and neutral conductors about the first insulating material layer.

6. The electrical power cable of claim 1 wherein:

the plurality of line conductors and the plurality of neutral conductors are arranged in two alternating groups about the first insulating material layer, each group formed of three of the line conductors and of three of the neutral conductors.

7. The electrical power cable of claim 1 wherein:

the plurality of groups of line conductors and the plurality of groups of neutral conductors are arranged in at least two separate groups of line conductors and at least two separate groups of neutral conductors about the first insulating material layer.

8. The electrical power cable of claim 1 further comprising:

an inner shield formed on an outer surface of the ground conductor.

9. The electrical power cable of claim 1 further comprising:

an inner shield means formed of an electrically conductive, grounded layer surrounding the first insulating material layer; and an insulating material layer surrounding the grounded layer and contacting the plurality of line conductors and the plurality of neutral conductors.

10. The electrical power cable of claim 9 wherein:

an outer diameter of the insulating material layer surrounding the grounded layer disposes the plurality of line conductors and the plurality of neutral conductors in one annular layer.

11. The electrical power cable of claim 1 wherein:

each of the plurality of line conductors and the plurality of neutral conductors are formed of one of a solid electrical conductor, a stranded electrical conductor, a "perfect" electrical conductor, and a concentric lay electrical conductor.

12. The electrical power cable of claim 1 wherein:

a total diameter of the ground conductor and the first insulating layer disposes the plurality of line conductors and the plurality of neutral conductors in one annular layer.

13. The electrical power cable of claim 12 wherein the second and third insulating material layers of each of the plurality of line conductors and the plurality of neutral conductors, respectively, are in non-moveable registry with adjacent second and third insulating material layers.

14. The electrical power cable of claim 1 wherein:

the first, second, third and fourth insulating material layers are provided in thicknesses to dispose outer surfaces of each line conductor and each neutral conductor at equal spacings from an inner surface of the outer shield, the outer surfaces of adjacent line and neutral conductors, and from an inner ground surface spaced radially inward from the line and neutral conductors.

15. The electrical power cable of claim 1 wherein:

the first, second, third, fourth and the outer insulating material layers are formed of a substantially non-compressible material.

16. The electrical power cable of claim 1 wherein the plurality of line conductors and the plurality of neutral conductors each comprise four 20 gage conductors having a total cross-sectional area substantially equal to a cross-sectional area of one 14 gage conductor.

17. The electrical power cable of claim 16 wherein:

the plurality of groups of the neutral conductors and the plurality of groups of line conductors are arranged in an alternating one-to-one arrangement.

18. The electrical power cable of claim 16 wherein:

the plurality of the neutral conductors and the plurality of the line conductors are arranged in a pair in each single group, with each group of line conductors disposed between adjacent arranged pairs of neutral conductors, and each group of neutral conductors arranged between two adjacent disposed groups of line conductors.

19. The electrical power cable of claim 16 wherein:

the ground conductor has a diameter larger than a minimum diameter conductor for a preselected cable ampere rating.

20. The electrical power cable of claim 1 wherein:

the plurality of line conductors in all of the plurality of groups of line conductors and the plurality of neutral conductors in all of the plurality of groups of neutral conductors each comprise six 20 gage conductors having a total cross-sectional area substantially equal to one 12 gage conductor.

21. The electrical power cable of claim 20 wherein:

the neutral conductors and the gage line conductors are arranged in two pairs each, with each group of line conductors disposed between adjacent arranged groups of neutral conductors, and each group of neutral conductors arranged between two adjacent disposed groups of line conductors.

22. The electrical power cable of claim 20 wherein:

the neutral conductors and the line conductors are arranged in four alternating groups, each group formed of three neutral or three line conductors.

23. The electrical power cable of claim 20 wherein:

the plurality of groups of the neutral conductors and the plurality of groups of the line conductors are arranged in an alternating one-to-one arrangement.

24. An electrical cable having a central axis comprising;

an inner conductive shield disposed at a first diameter;

a non-conductive, non-grounded inner support at the central axis having an outer diameter, the inner conductive shield solely supported by the inner support at the first diameter;

a first insulating material disposed about the inner shield;

at least one line conductor the at least one line conductor covered with a second layer of insulation material, the at least one line conductor circumferentially disposed about the first insulating material layer;

at least one neutral conductors, each neutral conductor covered by a second layer of insulating material, each neutral conductor circumferentially disposed about the first insulating material layer;

an outer conductive shield disposed about the at least one line conductor and the at least one neutral conductor;

an outer insulating layer disposed about the outer shield.

25. An electrical cable comprising:

an inner conductive shield disposed at a first diameter;

a non-conductive, non-grounded inner support at the central axis having an outer diameter contacting and solely supporting the inner shield at the first diameter;

the inner support being one of a solid inner support and a hollow tube support devoid of material between an inner diameter and the central axis of the electrical power cable;

a first insulating material disposed about the inner shield;

a plurality of line conductors arranged in a plurality of groups of line conductors;

each of the plurality of line conductors covered with a second layer of insulation material, the plurality of groups of line conductors circumferentially disposed about the first insulating material layer;

a plurality of neutral conductors arranged in a plurality of groups of neutral conductors;

each of the plurality of neutral conductors covered by a second layer of insulating material, each of the plurality of groups of neutral conductors circumferentially disposed about the first insulating material layer;

an outer conductive shield disposed about the plurality of groups line conductors and neutral conductors; and an outer insulating layer disposed about the outer shield.

26. An electrical power cable comprising:

an inner conductive shield disposed at a first diameter;

a non-conductive, non-grounded inner support supporting the inner shield at the first diameter;

a first insulating material disposed about the inner shield;

a plurality of line conductors arranged in a plurality of groups of line conductors, each line conductor covered with a second layer of insulation material, each line conductor circumferentially disposed about the first insulating material layer;

a plurality of neutral conductors arranged in a plurality of groups of neutral conductors, each neutral conductor covered by a second layer of insulating material, each neutral conductor circumferentially disposed about the first insulating material layer;

each group of line conductors including a single line conductor and each group of neutral conductors including a single neutral conductor; and an outer conductive shield disposed about the plurality of line conductors and the plurality of neutral conductors;

an outer insulating layer disposed about the outer shield; and the plurality of groups of line conductors and the plurality of groups of neutral conductors arranged in alternating one-to-one group arrangement about the first insulating material layer.

27. An electrical power cable wherein:

an inner conductive shield disposed at a first diameter;

a non-conductive, non-grounded inner support supporting the inner shield at the first diameter;

a first insulating material disposed about the inner shield;

a plurality of line conductors arranged in a plurality of groups of line conductors, each line conductor covered with a second layer of insulation material, each line conductor circumferentially disposed about the first insulating material layer;

a plurality of neutral conductors arranged in a plurality of groups of neutral conductors, each neutral conductor covered by a second layer of insulating material, each neutral conductor circumferentially disposed about the first insulating material layer;

an outer conductive shield disposed about the plurality of line conductors and the plurality of neutral conductors;

an outer insulating layer disposed about the outer shield;

an outer conductive shield disposed about the plurality of line conductors and the plurality of neutral conductors;

each group of line conductors includes a pair of line conductors and each group of neutral conductors includes a pair of neutral conductors; and the plurality of groups of line conductors and the plurality of groups of neutral conductors arranged in alternating pairs of line conductors and neutral conductors about the first insulating material layer.

28. An electrical power cable comprising:

an inner conductive shield disposed at a first diameter;

a non-conductive, non-grounded inner support supporting the inner shield at the first diameter;

a first insulating material disposed about the inner shield;

a plurality of line conductors arranged in a plurality of groups of line conductors, each line conductor covered with a second layer of insulation material, each line conductor circumferentially disposed about the first insulating material layer;

a plurality of neutral conductors arranged in a plurality of groups of neutral conductors, each neutral conductor covered by a second layer of insulating material, each neutral conductor circumferentially disposed about the first insulating material layer;

an outer conductive shield disposed about the plurality of line conductors and the plurality of neutral conductors;

an outer insulating layer disposed about the outer shield;

each group of line conductors including three neutral conductors and each group of neutral conductors includes a pair of neutral conductors; and the plurality of groups of line conductors and the plurality of groups of neutral conductors arranged in alternating groups of three line conductors and alternating groups of three neutral conductors about the first insulating material layer.

29. An electrical power cable having a central axis comprising:

an inner conductive shield disposed at a first diameter;

a non-conductive, non-grounded inner support at the central axis solely supporting the inner shield at the first diameter, the inner support being a solid inner support;

a first insulating material disposed about the inner shield;

a plurality of line conductors, each line conductor covered with a second layer of insulation material, each line conductor circumferentially disposed about the first insulating material layer;

a plurality of neutral conductors, each neutral conductor covered by a second layer of insulating material, each neutral conductor circumferentially disposed about the first insulating material layer;

an outer conductive shield disposed about the plurality of line conductors and the plurality of neutral conductors;

an outer insulating layer disposed about the outer shield.

30. An electrical power cable having a central axis comprising:

an inner conductive shield disposed at a first diameter;

a non-conductive, non-grounded inner support at the central axis having an outer diameter contacting and solely supporting the inner shield at the first diameter, the inner support being a hollow tube support devoid of material between an inner diameter and the central axis of the electrical power cable;

a first insulating material disposed about the inner shield;

a plurality of line conductors, each line conductor covered with a second layer of insulation material, each line conductor circumferentially disposed about the first insulating material layer;

a plurality of neutral conductors, each neutral conductor covered by a second layer of insulating material, each neutral conductor circumferentially disposed about the first insulating material layer;

an outer conductive shield disposed about the plurality of line conductors and the plurality of neutral conductors; and an outer insulating layer disposed about the outer shield.

* * * * *